United States Patent [19]

Svec

[11] 4,024,300

[45] May 17, 1977

[54] PROCESS FOR MAKING AN INVESTMENT MOLD FOR CASTING AND SOLIDIFICATION OF SUPERALLOYS THEREIN

[75] Inventor: Paul S. Svec, Scotia, N.Y.

[73] Assignee: General Electric Company, Schenectady, N.Y.

[22] Filed: June 27, 1975

[21] Appl. No.: 590,970

[52] U.S. Cl. ..... 427/133; 164/25; 427/202

[51] Int. Cl.[2] ..... B29C 1/04; B44D 1/20

[58] Field of Search ..... 427/133, 185, 205, 202; 164/25, 26

[56] References Cited

UNITED STATES PATENTS

| | | | |
|---|---|---|---|
| 3,583,468 | 6/1971 | Cutler | 164/26 |
| 3,751,276 | 8/1973 | Beyer et al. | 427/133 |
| 3,754,945 | 8/1973 | Moore | 427/133 |
| 3,788,380 | 1/1974 | Jasson et al. | 164/26 |
| 3,859,153 | 1/1975 | Beyer et al. | 164/26 |
| 3,899,612 | 8/1975 | Emblem | 164/26 |
| 3,933,190 | 1/1976 | Fassler et al. | 164/26 |

*Primary Examiner*—Harry J. Gwinnell
*Assistant Examiner*—S. Silverberg
*Attorney, Agent, or Firm*—Donald M. Winegar; Joseph T. Cohen; Jerome C. Squillaro

[57] ABSTRACT

A process for making shell investment molds for the casting and solidification of superalloys therein embodies preparing a primary slurry composition of a mixture of at least two different flour grain sizes of fused alumina and a silica binder. The flour grain sizes range from approximately 240 mesh to approximately 400 mesh, U.S. Standard or Tyler screen series.

21 Claims, No Drawings

PROCESS FOR MAKING AN INVESTMENT MOLD FOR CASTING AND SOLIDIFICATION OF SUPERALLOYS THEREIN

BACKGROUND OF THE INVENTION

1. Field of the Invention

This invention relates to the process for making shell investment molds for the casting and solidification of superalloys therein.

2. Description of the Prior Art

Shell investment molds are employed to produce castings of a wide variety of alloys with a refractory material, compatable with the alloying being cast forming the inner mold wall. The secondary or back-up coats usually are composed of a high alumina-silicate refractory of an appropriate grain size to insure production of a useable mold. Long periods of time, up to 10 hours, coupled with high temperatures (1500°–1600° C) caused undesirable mold defects, such as total collapse after casting the alloys, premature cracking and mold warpage. All of these, of course, produce undesirable and unacceptable castings. Mold-metal reactions, such as "pock marks", were also noted, suggesting that the inner or primary coats became contaminated with excessive amounts of $SiO_2$, $Na_2O$, and other fluxing agents which were not compatable with the alloy being cast.

An object of this invention is to provide a new and improved process for making shell investment molds for the casting and solidification of superalloys which overcome the deficiencies of the prior art.

An object of this invention is to provide a new and improved process for making a slurry suitable for making shell investment molds suitable for use for extended periods of time at high temperatures.

Another object of this invention is to provide a new and improved primary slurry composition for an investment mold, the material of which at the mold-metal interface is non-reactive to the metal in contact therewith.

Another object of this invention is to provide a new and improved alumina slurry to withstand the effects of mold-metal reactions at the mold-metal interface, such as required for the directional solidification of nickel-base superalloys and high-temperature nickel-base eutectic alloys requiring long solidification periods to obtain the desired cast structure.

Other objects of this invention will, in part, be obvious and will, in part, appear hereinafter.

BRIEF DESCRIPTION OF THE INVENTION

In accordance with the teachings of this invention, there is provided a material composition suitable for use in making shell investment molds. The material composition comprises a pre-selected weight of a flour mixture consisting of at least two different flour grain sizes of fused alumina. The grain sizes range from approximately 240 mesh to approximately 400 mesh, U.S. Standard or Tyler screen series.

A pre-selected weight of a colloidal silica is employed as a binder. In addition, a pre-selected volume of a wetting agent ranging from 8 to 12 cc per 100 lbs of slurry mixture may be added to the mixture. The ratio of weight percent of the flour to the binder is 73:27 to 65:35. Preferably, the fused alumina flour employed is acid-washed to remove free iron contamination resulting from its manufacture and has an $Al_2O_3$ purity of greater than 98%. The weight percent of silica in the colloidal silica binder is from 15 to 36 percent.

When a flour mixture consists of two different flours, the ratio of the larger grain to the smaller grain flour may vary from between 10:90 and 90:10. When the mixture consists of three different flour sizes, the first or coarse flour comprises from 70 to 75% weight percent of the mixture, the second flour comprises from 10 to 20%, and the third or smallest grain size flour comprises the remainder.

DESCRIPTION OF THE PREFERRED EMBODIMENT

Unexpectedly, I have found that a mixture of two or more flour sizes of fused alumina provide an excellent material composite for the one or more primary coats required to form a suitable inner mold wall for the casting of metal therein and the directional solidification thereof. Fused alumina flour sizes are closely controlled by the manufacturer, since they are basically produced for other uses. Therefore, a mixture of two or more fused alumina flours is preferred to acquire a grain size distribution to decrease voids at the metal-mold interface and to produce a slurry in which settling of the refractory flour is nil. Fused alumina is chosen because of its inherent low expansion and contraction properties, high temperature capability, and resistance to attack by the materials being cast.

Preferably, the flour is a high-purity alumina greater than 98% by weight $Al_2O_3$. The flour is acid-washed to remove impurities, such as iron, which is detrimental to the formulation of a suitable primary slurry.

Grain sizes must be considered since surface finish of molds and mold permeability is important when an acceptable casting is desired. A flour mixture containing a high percentage of large grains will produce a rough inner mold wall. This roughness is reproduced on the casting surface. A flour containing a large percentage of "fines" requires an excessive amount of binder and usually causes mold wall "buckling".

The colloidal silica binder is available as a commercial product and contains 36% silica by weight. This colloidal solution is diluted with de-ionized water to vary the silica content from 36% by weight to 15% by weight. I prefer to dilute the binder to 18% by weight and employ this diluted binder in the primary slurry. Total percentage of diluted binder may vary from 27% by weight to 35% by weight of the total slurry, depending on the flour mixture employed.

Other slurry additions are required. A wetting agent to ensure proper wetting of the wax pattern by the slurry. I prefer a non-ionic wetting agent since these are compatable with the binder (colloidal silica) employed. These agents are readily available commercially. Also, a defoaming agent may be required if excessive foam is noted on the slurry during the mixing operation. If good slurry mixing practices are followed, foaming will not be a serious problem. I have employed Antifoam 60, manufactured by the General Electric Company, in the amounts of 0.005% by weight to 0.008% by weight of the slurry, directly to the slurry. I have found 8cc to 12cc of wetting agent per 100 lbs. total weight of the slurry will induce good wetting properties to the slurry.

The following flour mixtures have been employed and yield satisfactory primary slurries. All percentages are by weight percent and all flours are fused alumina, U.S. Standard sieve size, acid washed.

| | |
|---|---|
| Mix No. 1: | Mix No. 6: |
| 240 mesh 50% | 240 mesh 65% |
| 400 mesh 50% | 320 mesh 35% |
| Mix No. 2: | Mix No. 7: |
| 240 mesh 66% | 240 mesh 85% |
| 320 mesh 34% | 400 mesh 15% |
| Mix No. 3: | Mix No. 8: |
| 240 mesh 50% | 240 mesh 70% |
| 320 mesh 50% | 320 mesh 25% |
| Mix No. 4: | 400 mesh 5% |
| 240 mesh 90% | Mix No. 9: |
| 320 mesh 10% | 240 mesh 85% |
| Mix No. 5: | 320 mesh 15% |
| 320 mesh 90% | Mix No. 10: |
| 400 mesh 10% | 240 mesh 10% |
| | 320 mesh 90% |

Unsatisfactory primary resulted when the following mixture was employed:

Mix No. 11: 240 mesh 100% Mix No. 12: 320 mesh 100%.

Primary slurries containing 100% 240 mesh $Al_2O_3$ flour produced fragile shells which cracked on dewaxing. Penetration of molten metal and casting roughness, which was unacceptable, resulted when the molds which did not crack on dewaxing were employed. Primary slurries containing 100%, 320 grain size flour, were difficult to keep in suspension without excessive stirring and produced mold defects such as mold wall "buckling".

The following is illustrative of the preparation of primary slurry compositions of this invention wherein I have selected Mix No. 4 containing 240 mesh fused alumina at 90% and 320 mesh fused alumina at 10% by weight of the flour mixture as a particular illustration. Total weight of the slurry (flour and binder) is 100 lbs. The dry flours are blended together for approximately 178 hour. Total weight of the binder is 27% by weight. The binder is colloidal silica diluted with de-ionized water to 18% silicon content. Therefore, 27 lbs. of this mixture is diluted binder and 73 lbs. is flour mixture No. 4.

Approximately 90% of the total weight of the flour mixture was added to all of the binder which is contained in a suitable mixer. The constituents were mixed together until the viscosity of the slurry became stabilized. The remainder of the flour mixture was then added to the slurry. The slurry of flour and binder were allowed to mix slowly overnight.

After mixing overnight, the specific gravity and viscosity of the slurry was checked. I prefer a specific gravity of from about 2.36 to about 2.42 and a viscosity of from 7 to 10 seconds with a No. 5 Zahn cup. An adjustment may be made at this time if specific gravity and viscosity are not at desired levels. Additionally, a defoamer may be added, in amounts previously stated, if foaming is a problem at this time.

A wetting agent is added only after the specific gravity and viscosity are at the desired levels for the slurry. Amounts of from about 8cc to about 12cc per 100 lbs. appear to be sufficient to induce good wetting properties. I allow from about 10 to 15 minutes for the wetting agent to be properly mixed throughout the slurry.

Several wax patterns were fabricated, cleaned and dried by standard established procedures well known to those skilled in the art. The wax patterns were then dipped into the primary slurry and the excess slurry was allowed to drain. When draining was completed, the bubble-free slurry coat was ready for graining. Graining was accomplished by means of fluid bed equipment. I prefer 70 grain fused alumina, acid washed, of 98% or greater purity as the grain employed for the graining or sand coat. This size grain forms an excellent grain coat to receive the next slurry dip coat. The wax pattern or cluster was allowed to air dry at room temperature for at least two hours.

When properly dried, the wax patterns or cluster was then dipped in the primary slurry and again coated with the 70 grain $Al_2O_3$. Again, the cluster was allowed to dry in air at room temperature for at least two hours. This procedure completed the application of the two primary coats which I prefer in making an investment mold. It is to be noted that when desired, more than two primary coats may be applied.

Secondary coats are then applied after the primary coats are dry enough to accept them. This is usually in about 2 hours after the last primary coat is applied. Secondary grain coats and slurry coats are applied in the same manner as the primary grain and slurry coats. However, the composition differs. For this shell mold composite the secondary slurry consists of 240 mesh fused alumina flour, acid washed, and 36 grit size fused alumina as the grain coat. I prefer to add four secondary coats each of which consists of one slurry dip and one 36 grain application. Drying time between each coat is at least 30 minutes. The binder is colloidal silica, of which 36 percent by weight is silica. The binder is not diluted. The ratio of undiluted binder to flour is 30:70. A slurry with a specific gravity of from about 1.9 to about 2.1 and a viscosity of approximately 6–7 seconds No. 5 Zahn cup is desired. A binder comprising about 30 percent by weight silica was also found to be suitable for making the secondary coating.

A "seal" coat consisting of the secondary slurry mixture is applied as the final coat. The purpose of the seal coat is to keep the last grain coat in place.

Preferably, I desire the shell investment mold for the aforementioned high temperature applications to be composed to two primary slurry coats each grained with 70 mesh fused alumina, four secondary slurry coats each grained with 36 mesh fused alumina, and one seal coat of secondary slurry. The complete shell is dried at room temperature, preferably overnight or for at least 12 hours. The shells are now ready for dewaxing.

Any standard technique well known to those skilled in the art may be employed for dewaxing. I prefer to employ the "flash dewax" technique. After dewaxing, the shells are fired in air at 1000° C for 1.5 hours and allowed to furnace-cool. The composition of the material of shell mold of the completed shells may then be stored for future use or employed immediately in the casting and solidification of super alloys.

Shell investment molds fabricated in the manner described heretofore are pre-heated to 1680°–1700° C and the superalloy materials previously described are cast therein and directionally solidified. The resulting castings are superior in quality of surface finish and composition of matter than those obtained by use of prior art molds.

Particularly, it has been discovered that the novel mold compositions, particularly the compsitions of the primary slurry coatings, enable the formation of a metal-mold barrier layer to be formed. It is this novel barrier, which is formed in a controlled prevailing furnace atmosphere, that is reducing for silica, which enables excellent surface finishes to be obtained for the castings. The reducing atmosphere enables alumina to dissolve into the silica and remove the silica from the mold-metal interface.

Upon drying the material the primary and secondary coatings have approximately the following composition:

1. Primary coating
   the alumina to silica ration by weight percent is from about 89:11 to approximately 95.5
2. Secondary coating
   the alumina to silica ratio by weight percent is from about 84:16 to approximately 93:7. Overall, alumina comprises from 80 to 99.9 percent by weight of the total mold material after drying.

I claim as my invention:

1. A process for making a shell investment mold comprising the steps of preparing a first mixture of at least two flour sizes of fused alumina selected from the grain size range of from approximately 240 mesh to approximately 400 mesh, U.S. Sieve Series, the fused alumina being acid washed to remove impurities;

b. adding a first predetermined quantity of the mixture of flours to a predetermined quantity of colloidal silica binder to form a primary slurry mixture, wherein the weight percent of silica in the binder is from 15 percent to 36 percent and the primary slurry mixture comprises from about 65 percent fused alumina flour mixture to about 73 percent fused alumina flour mixture, balance silica binder material;

c. mixing together the first mixture of flours and the binder until the viscosity of the primary slurry mixture becomes stabilized;

d. adding a second predetermined quantity of the first mixture of flour sizes to the primary slurry mixture;

e. mixing the first slurry mixture for a predetermined period of time;

f. adjusting the specific gravity of the primary slurry mixture, from about 2.36 to about 2.42;

g. adjusting the viscosity of the primary slurry mixture, from about 7 to about 10 seconds as measured with a No. 5 Zahn cup;

h. adding a predetermined volume of a wetting agent, as required, to the primary slurry mixture;

i. adding a predetermined weight of a defoaming agent, as required, to the primary slurry mixture;

j. mixing the primary slurry mixture and the additions, as required, for a predetermined period of time;

k. applying a coating layer of the primary slurry mixture to the wax pattern;

l. graining the coated pattern with a first grain coating material comprising fused alumina of a first preselected grain size;

m. repeating process steps (k) and (l) as often as required to form a plurality of alternate layers of primary slurry mixture and grain coating material;

n. preparing a secondary slurry mixture comprising fused alumina and a colloidal silica binder;

o. applying a coating layer of the secondary slurry mixture to the coated pattern;

p. graining the coated pattern with a second grain coating material of fused aluminum of second preselected grain size, and q. repeating process steps (o)and (p) as often as required to form a plurality of alternate layers of secondary slurry mixture and second grain coating material.

2. The process of claim 1 wherein the colloidal silica binder of the secondary slurry comprises about 30 to about 36 percent by weight silica of the binder material.

3. The process of claim 2 wherein the alumina mixture of the primary slurry mixture consists of two flour grain sizes, and the ratio of the coarse flour grain size to the fine flour grain size is from 10:90 and 90:10.

4. The process of claim 3 wherein the secondary slurry mixture comprises about 70 percent by weight fused alumina and the remainder is colloidal silica binder.

5. The process of claim 4 wherein the specific gravity of the secondary slurry mixture is from about 1.9 to about 2.1.

6. The process of claim 5 wherein the viscosity of the secondary slurry mixture is from approximately 6 seconds to approximately 7 seconds as measured by a No. 5 Zahn cup.

7. The process of claim 1 wherein the binder of the first slurry mixture contains about 18 percent by weight silica.

8. The process of claim 7 wherein the fused alumina of the first grain coat is of 70 grain size.

9. The process of claim 8 wherein the fused alumina of the second graining coat is of 36 grit size.

10. The process of claim 2 wherein the alumina mixture of the primary slurry mixture consists of three flour grain sizes, and the coarse flour grain size comprises from 70 to 75 percent by weight, the medium flour grain size comprises from 10 to 20 percent by weight, and the fine flour grain size comprises the remainder.

11. The process of claim 10 wherein the secondary slurry mixture comprises about 70 percent by weight fused alumina and the remainder is colloidal silica binder.

12. The process of claim 11 wherein the specific gravity of the secondary slurry mixture is from about 1.9 to about 2.1.

13. The process of claim 12 wherein the viscosity of the secondary slurry mixture is from approximately 6 seconds to approximately 7 seconds as measured by a No. 5 Zahn cup.

14. The process of claim 10 wherein the binder of the first slurry mixture contains about 18 percent by weight silica.

15. The process of claim 14 wherein the fused alumina of the first grain coat is of 70 grain size.

16. The process of claim 15 wherein the fused alumina of the second graining coat is of 36 grit size.

17. The process of claim 1 wherein the volume of the wetting agent added is from about 8 cubic centimeters to about 12 cubic centimeters per 100 pounds of primary slurry mixture.

18. The process of claim 17 wherein the wetting agent is non-ionic.

19. The process of claim 17 wherein the weight of defoaming agent is from about 0.005 percent to about 0.008 percent by weight of the primary slurry mixture.

20. The process of claim 2, wherein the purity of fused alumina is greater than 98 percent.

21. The process of claim 20 wherein the fused alumina is substantially free of iron contamination.

* * * * *